United States Patent [19]

Guilbault

[11] Patent Number: 4,679,787

[45] Date of Patent: Jul. 14, 1987

[54] COMBINED EXERCISE STATION AND SLEEPING BED

[75] Inventor: Joseph D. Guilbault, Solon, Ohio

[73] Assignee: The Stouffer Corporation, Solon, Ohio

[21] Appl. No.: 701,618

[22] Filed: Feb. 14, 1985

[51] Int. Cl.[4] ..... A63B 21/00; A47C 19/06

[52] U.S. Cl. ..... 272/93; 272/134; 272/69; 5/136; 5/164 R; 5/167

[58] Field of Search ..... 272/69.93, 145, 134, 272/144, 900, 73; 5/144, 145, 146, 147, 164, 136, 167, 168, 1, 508

[56] References Cited

U.S. PATENT DOCUMENTS

| | | | |
|---|---|---|---|
| 710,268 | 9/1902 | Hamilton . | |
| 1,229,722 | 6/1917 | Crebo . | |
| 1,368,205 | 2/1921 | Bell . | |
| 1,693,795 | 12/1927 | Moore . | |
| 1,834,794 | 6/1931 | Miller . | |
| 1,875,456 | 9/1932 | Heerdt . | |
| 2,202,248 | 5/1940 | Deschamps . | |
| 2,770,813 | 11/1956 | Marzillier | 5/136 |
| 3,226,115 | 12/1965 | Underhill . | |
| 3,738,649 | 6/1973 | Miller | 272/73 |
| 4,300,761 | 11/1981 | Howard | 272/73 |
| 4,378,939 | 5/1983 | Wild | 272/93 |

FOREIGN PATENT DOCUMENTS

| | | |
|---|---|---|
| 2712875 | 3/1977 | Fed. Rep. of Germany . |
| 16432 | 9/1912 | France . |
| 836201 | 10/1938 | France . |
| 1048822 | 9/1951 | France . |

OTHER PUBLICATIONS

*The Murphy Styleline Recess, Models SLM and SL,* Published by Murphy Door Bed Company.

The Sico Room Maker Wall Bed System Published by Sico Incorporated.

P. 31 from Eddie Bauer Catalog describing rowing machines and Flywheel 200 Exercise Bike.

Avita 950 Collapsible Rowing Machine published by M & R Industries Inc.

*Primary Examiner*—Richard J. Apley

*Assistant Examiner*—S. R. Crow

*Attorney, Agent, or Firm*—Body, Vickers & Daniels

[57] ABSTRACT

A combined exercise station and sleeping bed is provided allowing placement of safe exercise equipment and a bed in the same area normally occupied only by a bed. This allows placement of exercise equipment in a hotel room or other place of limited space. One edge of the bed is hinged to a slidable support so that the bed may be pivoted to a vertical position to expose exercise equipment normally located under the bed.

10 Claims, 9 Drawing Figures

COMBINED EXERCISE STATION AND SLEEPING BED

FIELD OF THE INVENTION

This invention pertains to the art of exercise equipment and more particularly to a structure for providing exercise equipment and a sleeping bed in the same space.

The invention is particularly applicable where it is desirable to provide safe, secure exercise equipment in the space previously reserved for a sleeping bed exclusively, as in hotels, and will be described with particular reference thereto although it will be appreciated that the invention has broader application and can be used in the home or elsewhere where both exercise equipment and sleeping beds are desirable.

BACKGROUND OF THE INVENTION

The maintenance of physical fitness has become important to many people in the last several years. Numerous exercise devices have been introduced in response to the demands of such people. Such devices include stationary jogging machines or treadmills, exercycles, stationary rowing machines, machines which simulate crosscountry skiing and other similar devices. All of these devices take up significant room in use and in storage. Many of these devices cannot be easily moved once set up for use and require extensive disassembly should one wish to store the device.

Many of the devices referred to above, such as exercycles, support the user above the floor. These devices are often used vigorously. If these devices are improperly assembled or positioned, the user may fall or injure himself through contact with adjacent surfaces or objects.

The devices described require space permanently dedicated to them where they can be stably erected and used without danger of the user encountering adjacent furniture or the like during exercise. Such devices were, heretofore, inappropriate for hotel rooms where space was at a premium.

In the past, hotels have met the demands of patrons for exercise facilities by providing a central exercise facility or spa. Weight lifting equipment, exercise equipment, and some sport recreational facilities were provided in the hotel for patrons. In some instances, professional staff was provided because of the potential hazard to untrained personnel presented by sophisticated exercise devices. These exercise facilities did not normally generate sufficient revenue to pay their costs. Moreover, such facilities occupied space which could otherwise be used for guest rooms.

In a heretofore unrelated area, hotels and others have used folding beds and tiltable beds to create dual purpose rooms. Thus, beds which fold into a sofa have long been used to convert a bedroom into a sitting room. Beds built into a wall or large cabinet and tiltable into the wall or cabinet have been used by hotels to allow the conversion of a sleeping room into a room usable for other purposes. Such tilting beds required more room than conventional stationary beds and provided no storage room when not in use. To applicant's knowledge, no such arrangement has ever been used to provide a combined exercise station and sleeping area.

SUMMARY OF THE INVENTION

The present invention contemplates a new combined exercise station and sleeping bed which overcomes all of the above referred to problems and others and provides a safe exercise station and a sleeping bed in minimal space.

In accordance with the present invention, there is provided, in combination, a bed and exercise station comprised of: a frame firmly fixed to the floor; a bed hinged at one end of the frame and movable from a horizontal sleeping position to a vertical position exposing the area normally under the bed; and, exercise equipment fixed in place under the bed and exposed by tilting the bed to the vertical position.

Further in accordance with the invention, the exercise equipment is easily collapsed into a storage position and erected from the storage position into a usable position.

Still further in accordance with the invention, the bed is hinged through a hinge positioning mechanism such that; the head of the bed is close to an adjacent wall when the bed is in the horizontal position; and the upper surface of the bed is close to an adjacent wall when the bed is in the vertical position; and, the bed pivots between these two positions without marring the adjacent wall.

"Close" is used herein to mean a distance of up of several inches, but significantly less than twenty-six inches, the normal height of a bed.

Yet further in accordance with the invention, the hinge positioning mechanism includes a slide provided with detents releasably holding the hinge in either a first position when the bed is in the horizontal position, whereby an edge of the bed is positioned near an adjacent wall, or a second position when said bed is in the vertical position, whereby the bed upper surface is disposed near an adjacent wall.

Still further in accordance with the invention, the hinge positioning mechanism comprises a shaft on the left side of the bed and a shaft on the right side of the bed supporting the hinge mechanism on bearings slidable upon these shafts; the bearings of the left side and right side shafts being rigidly interconnected by a cross brace preventing the hinge mechanism from binding on the shafts and facilitating smooth, easy movement of the mechanism.

Still further in accordance with the invention, biasing springs are connected between the pivoting bed and the cross brace, easing the lifting of the bed into the vertical position.

Still further in accordance with the invention, the exercise equipment is fixed to supporting members rigidly interconnected to the frame providing stability and ease of mounting for the exercise equipment.

The principal object of the invention is the provision of an exercise facility and a sleeping bed in the same space.

It is another object of the invention to provide exercise equipment securely fixed in place in the area normally occupied by a sleeping bed.

It is yet another object of the present invention to provide a bed tilting mechanism which allows a tiltable bed to have its head close to an adjacent wall in the horizontal position and its sleeping surface close to the same adjacent wall in the vertical position.

It is still another object of the present invention to provide a tiltable bed structure which can be easily installed and easily removed without marring adjacent walls.

It is yet another object of the present invention to provide a tiltable bed mechanism not requiring special wall construction or surrounding cabinetry for installation.

It is yet another object of the present invention to provide a bed tilting mechanism which is safe and easy to operate.

It is still another object of the present invention to provide a combined sleeping bed and exercise facility arrangement which may be easily installed in a hotel guest room, easily used by hotel patrons and easily and quickly removed from the hotel guest room should hotel management so desire.

The invention may take physical form in certain parts and arrangements of parts, a preferred embodiment of which will be described in detail in this specification and illustrated in the accompanying drawings which form a part hereof and wherein.

Figure 1:
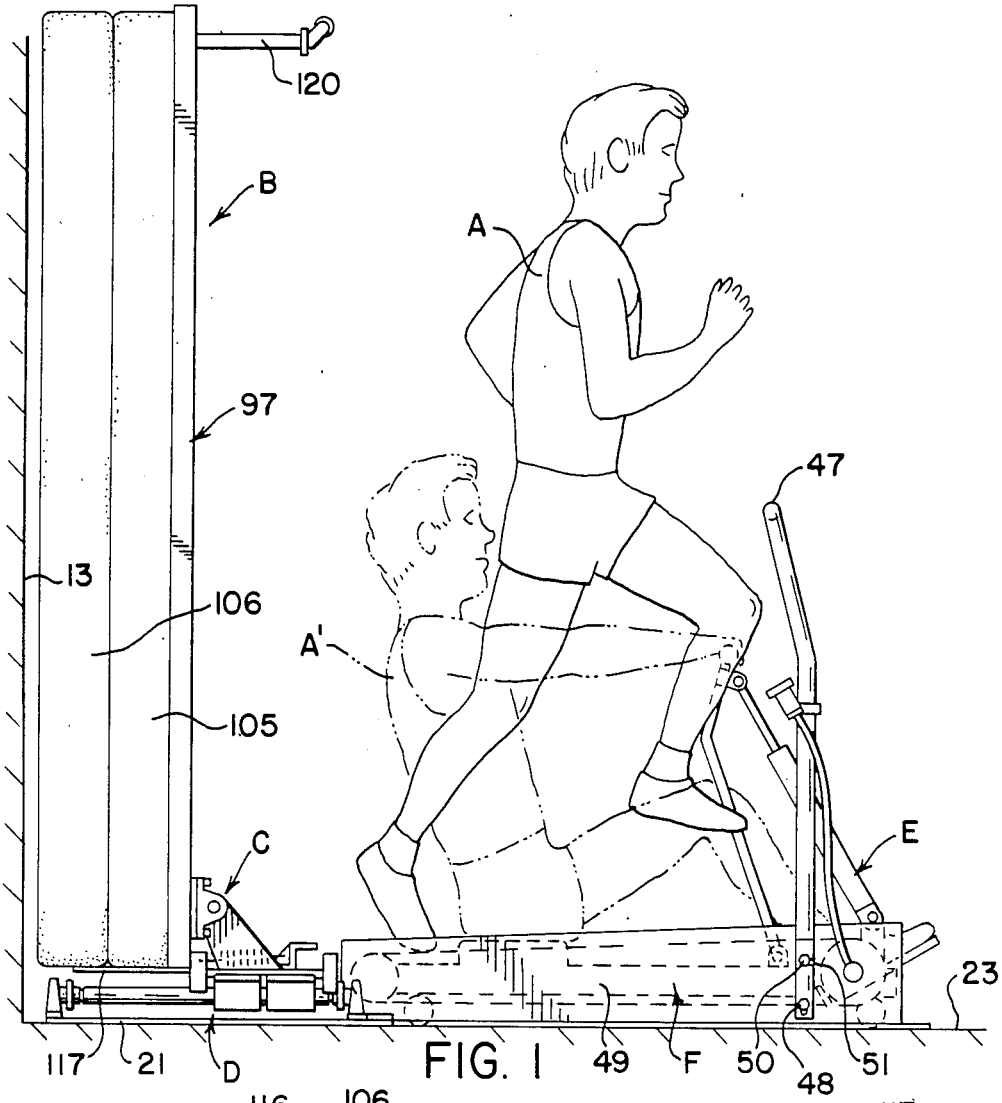
FIG. 1 is a side elevation of the preferred embodiment of the invention in the exercising configuration.
Figure 5:
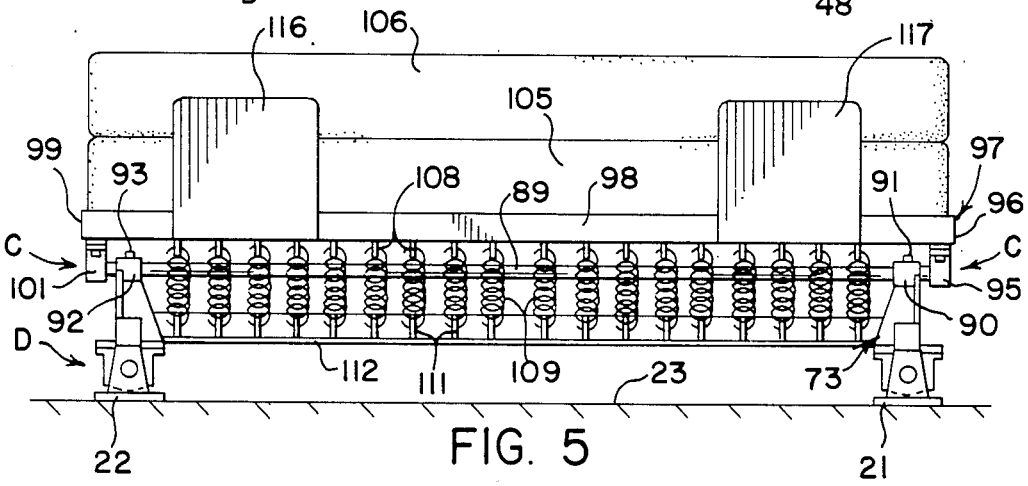
FIG. 5 is an end view of the preferred embodiment in the sleeping configuration showing the head end of the bed taken along lines 5—5 in FIG. 4.
Figure 2:
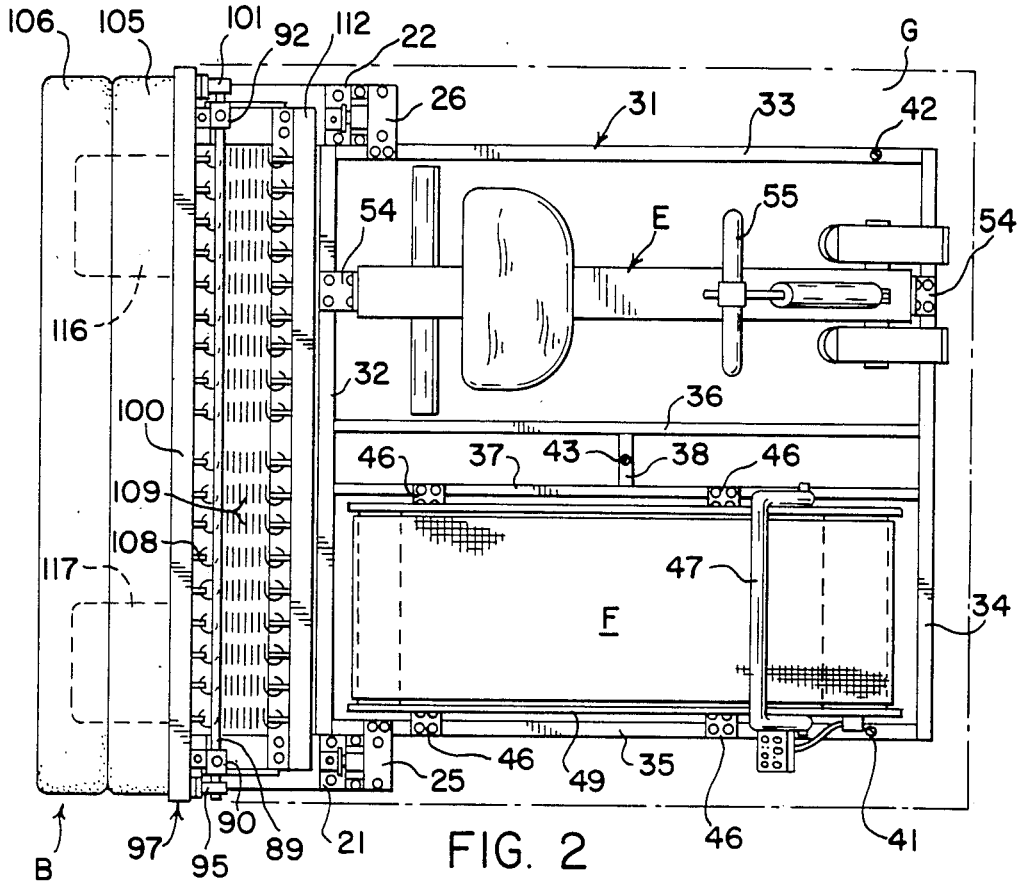
FIG. 2 is a plan view of the preferred embodiment in the exercising configuration.

Referring now to the drawings wherein the showings are for the purpose of illustrating a preferred embodiment of the invention only and not for the purpose of limiting same; FIG. 1 shows a double bed B hinged at one end by a movable hinge mechanism C to a frame D. The double bed B is shown in the vertical position to expose exercise apparatus, in this embodiment a rowing machine E and a treadmill F, shown with two exercisers A, A' in the exercising position.

The frame D comprises two identical rectangular base plates 21, 22 laterally spaced from one another by slightly less than the width of the bed B and spaced a short distance away from an adjacent wall 13. These base plates 21, 22 are firmly fixed to an underlying floor 23 in a conventional manner such as by lag bolts or concrete anchors 24 and provide the primary attachment points for all other elements of the combined exercise facility-sleeping bed.

Details of the frame D are shown in FIGS. 6 to 9. The right end elements of the frame D are the mirror images of the left end structures illustrated and described below.

Two shaft support blocks 61, 62 are fixed to the opposite ends of the base plate 21 and support a cylindrical bearing shaft 63 above the base plate with its axis perpendicular to the plane of the adjacent wall 13. The shaft 63 has two annular end rings 64, 65, one near each end of the shaft and two circumferential grooves 66, 67, one adjacent each end ring. A pair of pillow blocks 71, 72 are slidably mounted axially in line on the bearing shaft 63 and slidably support the left end of the hinge mechanism C.

Figure 8:
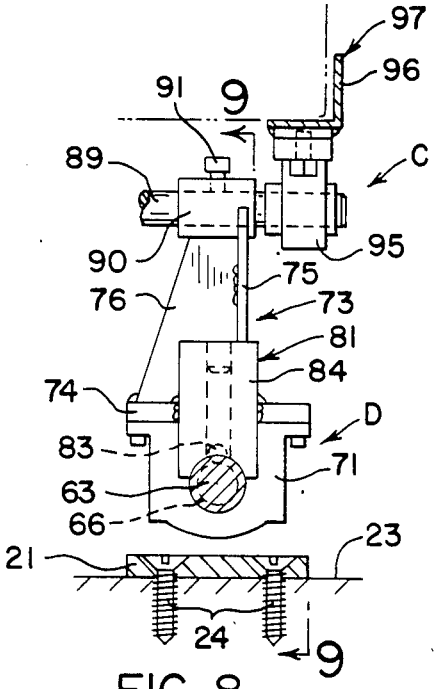
FIG. 8 is a cross section of the hinge structure taken along line 8—8 shown in FIG. 7.
Figure 9:
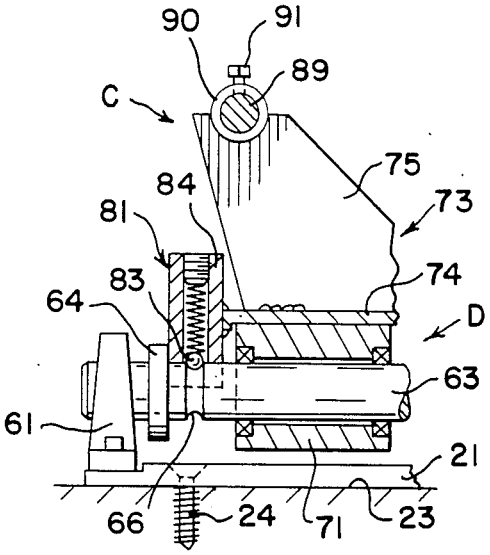
FIG. 9 is a cross section of the longitudinal slide taken along line 9—9 in FIG. 8.
Figure 3:
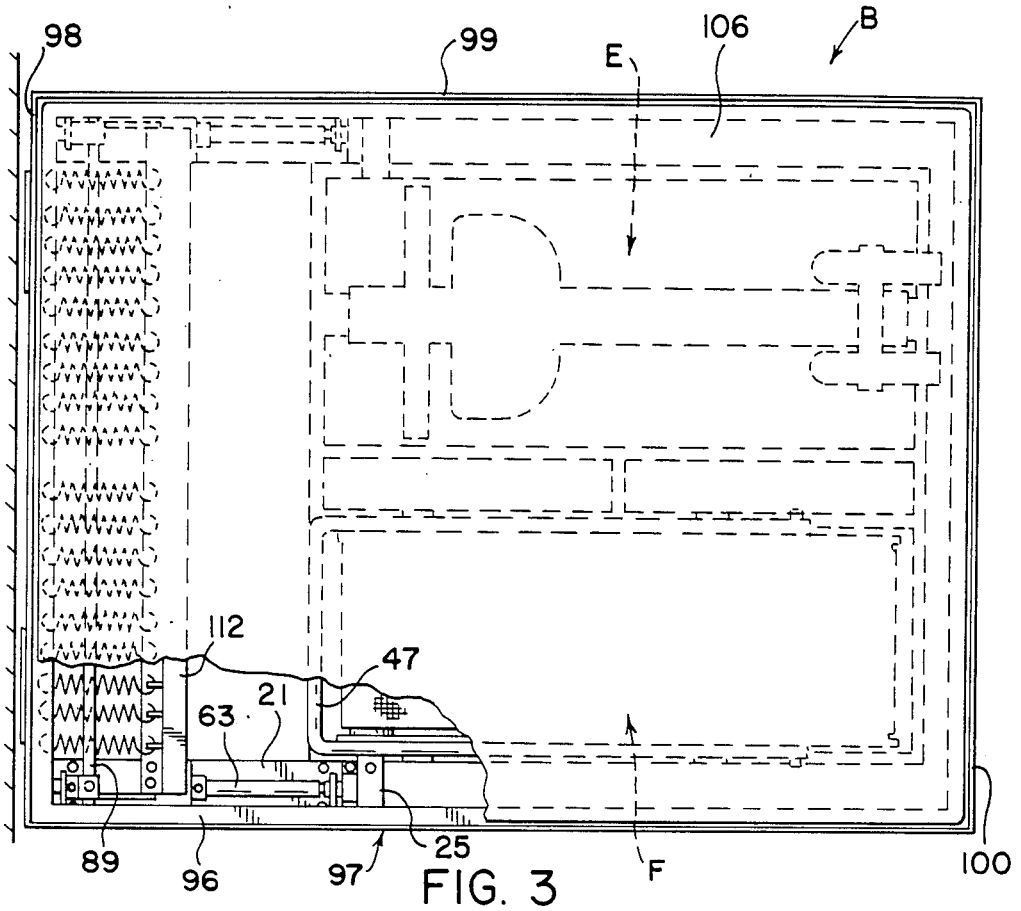
FIG. 3 is a plan view of the preferred embodiment in the sleeping configuration.
Figure 4:
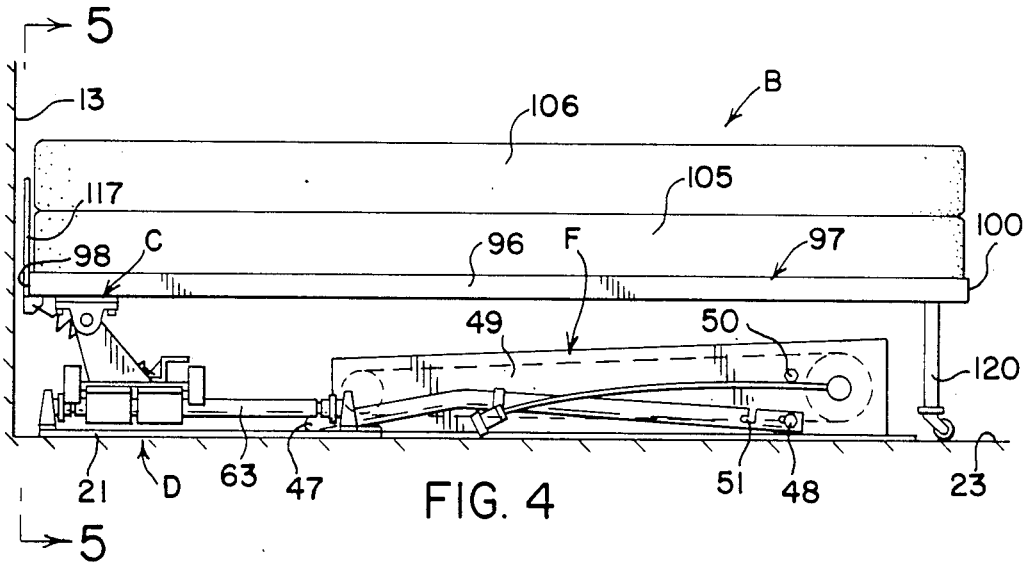
FIG. 4 is a side elevation of the preferred embodiment in the sleeping configuration.
Figure 6:
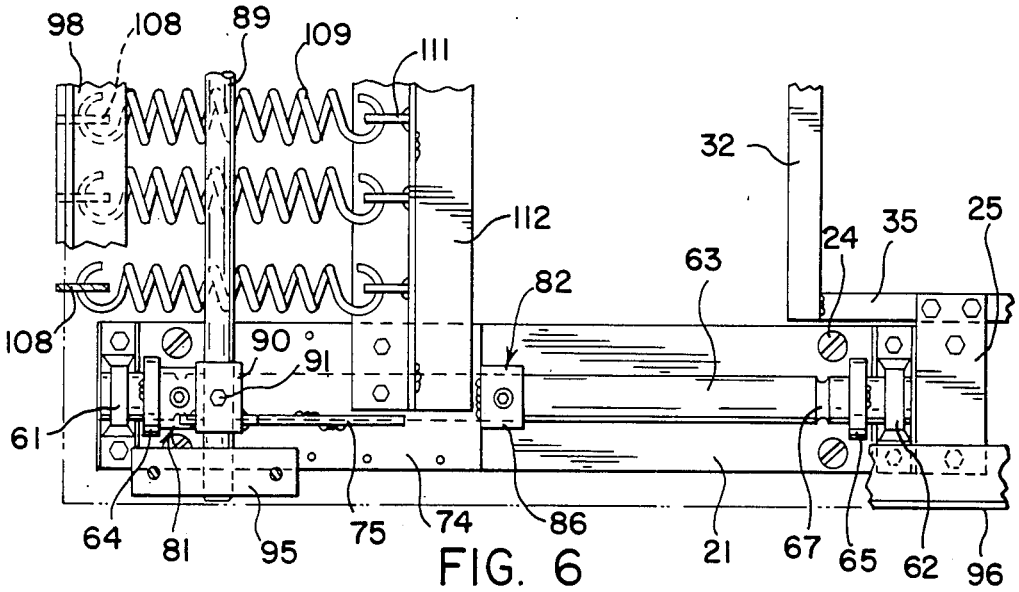
FIG. 6 is a plan detail of the left hand hinge structure in the sleeping configuration.
Figure 7:
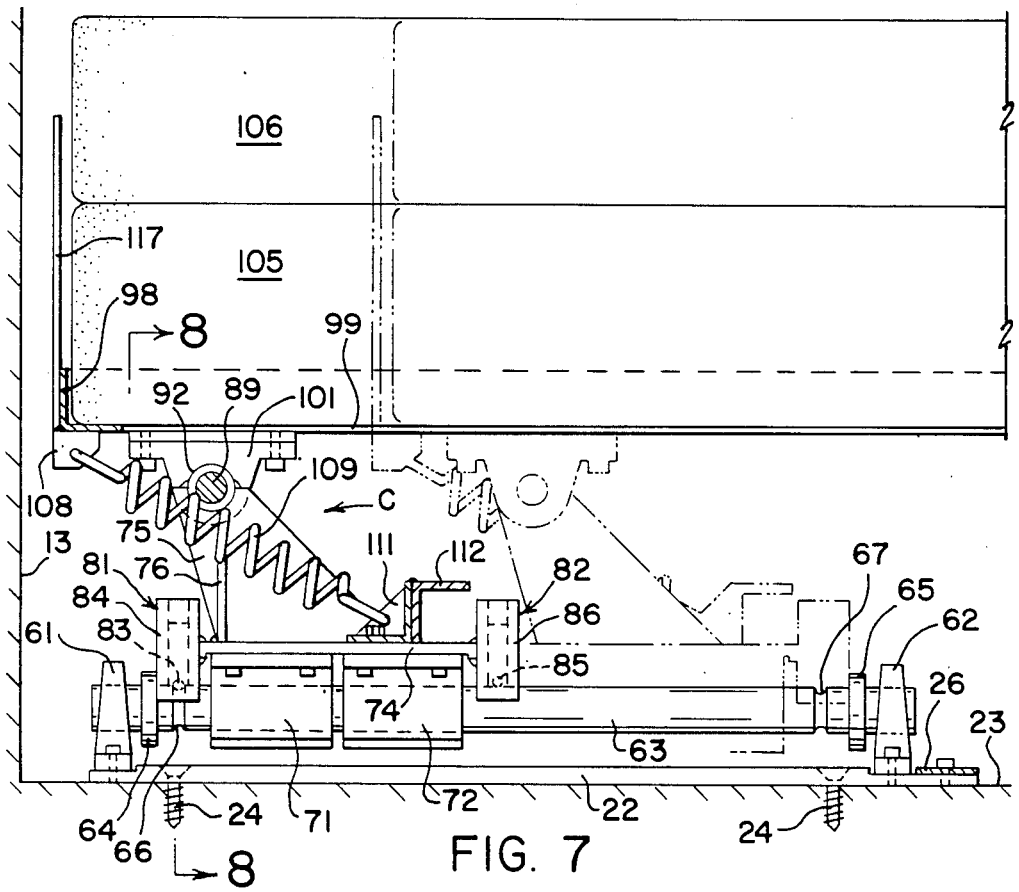
FIG. 7 is a side elevation detail of the right hand hinge structure in the sleeping configuration and showing in phantom the hinge in the exercise configuration.

The hinge mechanism C comprises a hinge support 73, best seen in FIGS. 7, 8 and 9, consisting of a rectangular horizontal plate 74 and two mutually perpendicular vertical plates 75, 76, all three plates bein welded together. The horizontal plate 74 is bolted to and directly above the pillow blocks 71, 72. Two end stops 81, 82 are welded to the opposite ends of the horizontal plate 74 near the adjacent wall 13 and away from the adjacent wall 13 respectively. Each end stop comprises a spring biased roller ball 83, 85 in a steel tube 84, 86. The tubes 84, 86 are sized such that when the hinge support 73 reaches the end of travel along the bearing shaft 63, one of the end stop tubes 84, 86 will engage one of the end rings 64, 65 and one of the spring biased roller balls 83, 85 will engage one of the grooves 66, 67. The roller balls 83, 85 are sized to fit into the grooves 66, 67.

The vertical plates 75, 76 rigidly support a collar 90 above the horizontal plate 74 such that its axis is coincident with the axis of rotation of the bed B. An identical collar 92 is supported above the right side base plate 22 by a right side hinge support which is the mirror image of the left side hinge support 73.

A pivot shaft 89 is fixedly supported near its left end by the left side collar 90 and a set screw 91 and near its right end by the right side collar 92 and a set screw 93. A left side bed pillow block 95 and a right side bed pillow block 101 are rotatably mounted on the two ends of the pivot shaft 89 and support the bed B so that it may pivot from a horizontal position to a vertical position.

The bed B has a rectangular frame 97 composed of a left side rail 96, a head rail 98, a right side rail 99 and a foot rail 100 supporting a spring foundation 105 and a mattress 106. The left side bed pillow block 95 and the right side bed pillow block 101 are attached to the left side rail 96 and the right side rail 99, respectively, near the head rail 98. Thus, bed frame 97, spring foundation 105 and mattress 106 are supported on, and free to rotate around, pivot shaft 89.

The head rail 98 of the bed frame 97 is provided with a plurality of vertical tabs 108 to which a plurality of bias springs 109 are fixed. The lower ends of the bias springs 109 are fixed to a plurality of anchor tabs 111 on a cross brace 112 comprised of two pieces of angle iron welded together which is bolted to the horizontal plates 74 of the left side and right side hinge supports.

The cross brace 112 not only provides an anchoring position for the lower end of bias springs 109 but also rigidly interconnects the left side and the right side hinge supports. This rigid interconnection and the long bearing area supplied by the pairs of pillow blocks 71, 72 on each bearing shaft 63 maintain the bed B, the hinge structure C, and the frame D in good alignment thereby preventing binding and jamming of the slide mechanism.

Two large rectangular mattress support plates 116, 117 are welded to the head rail 98 and support the spring foundation 105 and mattress 106 when the bed is in the vertical position.

With the bed B thus supported in the vertical position, the area normally occupied by the bed, bed space G is exposed. The rowing machine E and the treadmill F are fixed in this space by connection to frame D.

Two rectangular tie plates 25, 26 are fixed by machine screws or the like to the ends of base plates 21, 22 disposed away from the adjacent wall 13. One tie plate 25 is fixed to the left side base plate 21 and the other tie plate 26 is fixed to the right side base plate 22. Both of the tie plates 25, 26 are also fixed to a rectangular equipment base 31 which lies entirely within the bed space G. The equipment base 31 is comprised of several long strait members. A head end peripheral member 32, a right side peripheral member 33, a foot end peripheral member 34 and a left side peripheral member 35 are connected to form the outline of the equipment base 31 and surround the exercise equipment, in the embodiment illustrated a rowing machine E and a treadmill F.

It should be appreciated that other types of exercise equipment such as an exercycle or a machine which simulates cross country skiing could also be used.

Two closely spaced central longitudinal members 36, 37 connect the head end peripheral member 32 and the foot end peripheral member 34 and are parallel to the left side peripheral member 35 and the right side peripheral member 33. The two central longitudinal members 36, 37 are interconnected at their centers by a short cross member 38.

Additional lag screw holes 41, 42, 43 are provided in the left hand peripheral member 35, the right hand peripheral member 33, and the short cross member 38 for fixing equipment base 31 to the floor 23. The screw holes 41, 42, 43 are not always used in the preferred embodiment of the invention as the connection to the base plates 21, 22 provided by the tie plates 25, 26 is usually sufficient for stability.

The jogging machine or treadmill F is conventional and firmly fixed in place between the left side peripheral member 35 and the left central longitudinal member 37 by fastening the treadmill F at its base 49 to four identical treadmill tie plates 46. Two of the treadmill tie plates 46 are screwed to the left side peripheral member 35 and two of the treadmill tie plates 46 are screwed to the left central longitudinal member 37.

The treadmill F is provided with a handlebar 47 having an elevated horizontal portion and two vertical portions extending downwardly to engage either side of the treadmill base 49. Each of the vertical portions of the handlebar 47 is fixed to the treadmill base 49 at its lower end by a lower threaded fastener 48 and an upper threaded fastener 50. The upper threaded fasteners are disposed in horizontal slots 51 in the handlebar 47. The slots 51 open to the front of the handlebar. When the treadmill F is no longer desired, the upper threaded fasteners 50 are loosened and the handlebar 47 pivoted about the lower threaded fasteners 48 into a horizontal position. The horiztonal slots 51 allow the upper threaded fasteners 50 to remain in place without interfering with the pivoting of the handlebar 47.

The rowing machine E is fixed to the equipment base 31 next to the treadmill F by two identical rowing machine tie plates 54. One rowing machine tie plate is fixed to the head end peripheral member 32 and the other rowing machine tie plate is fixed to the foot end peripheral member 34. The rowing machine has a handle 55 which can be raised to a vertical position for use or lowered to a horizontal position for storage without other adjustment.

Thus, the treadmill F and the rowing machine E are easily and safely used in the bed space G conventionally occupied by the bed B as they are firmly fixed to the equipment base 31. The devices may be used vigorously without fear of the devices upsetting or changing position through vibratory motion. Inadvertent movement of the device and user into contact with the bed frame or other hard objects is prevented.

Of course. exercise equipment other than a treadmill and a rowing machine can be used in this arrangement and fixed to the equipment base 31. Thus, a collapsible exercycle or the like can be fixed to the equipment base 31 so long as it is capable of being collapsed to a height sufficiently low to fit under the bed B when the bed is in the sleeping position.

The preferred embodiment has thus far been described in the exercise position with the bed B disposed vertically. Once a hotel guest has finished his exercise, he may lower the bed in the following manner. First, the rowing machine handle 55 and the treadmill handlebar 47 are placed in the lowered position. The bed frame 97 is then grasped by the guest and the entire bed structure is rotated about the pivot shaft 89 into the horizontal position. During this rotating movement, the bias springs 109 act against the force of the weight of the bed B making the rotation an easily controlled motion. As the bed comes into the horizontal or sleeping position, two foot end legs 120 rest upon the floor. The bed B is then in the horizontal position and somewhat displaced from the adjacent wall 13. The hotel guest now pushes the foot of the bed B toward the adjacent wall 13. This causes the roller balls 85 in the end stops 82 to disengage from the outboard bearing shaft grooves 67 and allows the hinge supports 73 and blocks 71, 72 to easily and smoothly slide along the bearing shafts 63. The bed moves toward the adjacent wall until the tubes 84 on the hinge supports 73 encounter the end rings 64 and the roller balls 83 engage the inboard grooves 66 on the bearing shafts 63. The bed B is now locked in the sleeping position with the head close to the adjacent wall 13. In this position, the bed B occupies the same area as a conventional bed of the same size and has a similar appearance. The underlying exercise equipment and hinge mechanism are totally contained under the bed and may be concealed by the bed covers or bedspread if desired. Thus, a standard hotel room containing a double bed accomodates the exercise station described with no additional space requirements.

In order to raise the bed and gain access to the exercise station described, the lowering procedure is simply reversed. The bed B is pulled away from the adjacent wall 13 until the roller balls 85 snap into engagement with the outboard grooves 67 on the shaft 63. The bed is then rotated and tilted into the vertical position or exercise position. The bias springs 109 aid in this movement. With the bed pulled away prior to the tilting movement, the adjacent wall is not contacted by the tilting bed or damaged in any other manner.

Once the bed is rotated into the vertical position, it is stable in this position as its center of mass is on the side of the pivot shaft 89 near the adjacent wall 13.

Should it be desirable to remove the exercise station from a hotel room, it is a simple matter to remove the lag screws 24 fixing the entire structure to the floor. The exercise station-sleeping bed is then disassembled and removed from the room. Either a normal bed may be placed in the bedspace G of the exercise station-sleeping bed combination, or the holes in the floor or carpet made for the lag screws may be patched in a conventional manner.

No mounting hardware needs to be placed in the adjacent wall and no cabinetmaking or other special carpentry is required for the installation of the above desired unit.

While the device is extremely portable, it is also extremely robust and safe to use.

The above described unit is manually powered in its operation. It is also possible to electrically power the unit by connecting an electric motor through an appropriate gear reducer to a rack and pinion attached to the left hinge support 73 and base plate 21 to drive the hinge structure C back and forth. A second electrical motor would then be connected through appropriate gearing to pivot shaft 89. Pivot shaft 89 is made to rotate with the bed B instead of remaining stationary as in the manual embodiment. End stops 81, 82 are dispensed with and proximity switches mounted in their place. Proximity switches would also be mounted to sense the arrival of the bed B at the vertical and horizontal positions. Control logic would then move bed B from the vertical to the horizontal position or vice versa and lock the bed in place at the touch of a button.

The invention has been described with reference to a preferred embodiment. Obviously, modifications and alterations will occur to others upon the reading and understanding of this specification. It is my intention to include all such modifications and alterations insofar as they come with the scope of the appended claims or the equivalents thereof.

Having thus described the invention I claim:

1. A combined bed and exercise apparatus comprising, in combination:

a frame means adapted to be firmly fixed in place to a floor;

a bed having a head portion, a foot portion, two side edges and an upper surface;

a hinge fixed to said frame means and pivotally supporting one end of said bed above said frame means such that said bed is pivotable between a vertical position and a horizontal position, said bed being positioned over a bed space in said horizontal position; and, excercise equipment immovably fixed in place on said frame means and immovably secured on said floor within said bed space and collapsible for accommodation and concealment thereof beneath said bed when in its horizontal position, said exercise equipment being exposed in its fixed position on the said fixed frame means, when said bed is in said vertical position, to thereby enable normal usage of the so exposed said exercise equipment.

2. The apparatus of claim 1 wherein said frame means comprises two base plates and said apparatus includes hinge positioning means mounted on said base plates and supporting said hinge in a first position when said bed is in the horizontal position such that one edge of said bed is disposed near an adjacent wall and a second position when said bed is in the vertical position such that said bed upper surface is disposed near said adjacent wall.

3. A combined bed and exercise apparatus comprising, in combination:

a frame adapted to be firmly fixed in place;

a bed having a head portion, a foot portion, two side edges and an upper surface;

a hinge fixed to said frame and pivotably supporting one end of said bed above said frame such that said bed is pivotable between a verticle position and a horizontal position, said bed being positioned over a bed space in said horizontal position;

exercise equipment fixed in place in said bed space such that said exercise equipment is usable when said bed is in said vertical position; and, hinge positioning means supporting said hinge in a first position when said bed is in the horizontal position such that one edge of said bed is disposed near an adjacent wall and a second position when said bed is in the vertical position such that said bed upper surface is disposed near said adjacent wall, said hinge positioning means being comprised of two bearings supporting said hinge and being slidably supported along respective ones of two slide shafts located near opposite sides of said bed and extending normal to the pivot axis of said hinge, each said slide shaft being provided with at least two recesses adapted to receive spring loaded projections fixed to said bearings and riding along said shafts, said spring loaded projections interacting with said recesses to form detents releaseably holding said hinge in said first position or said second position.

4. A combined bed and exercise apparatus comprising, in combination:

a frame adapted to be firmly fixed in place and comprised of two base plates;

a bed having a head portion, a foot portion, two side edges and an upper surface;

a hinge fixed to said frame and pivotably supporting one end of said bed above said frame such that said bed is pivotable between a vertical position and a horizontal position, said bed being positioned over a bed space in said horizontal position;

excercise equipment fixed in place in said bed space such that said exercise equipment is usable when said bed is in said vertical position; and, hinge positioning means supporting said hinge in a first position when said bed is in the horizontal position such that one edge of said bed is disposed near an adjacent wall and a second position when said bed is in the vertical position such that said bed upper surface is disposed near said adjacent wall, said hinge positioning means being comprised of a left side slide shaft fixed to one of said two base plates, a right side slide shaft fixed to the other of said two base plates, at least one left side bearing slidably supported on said left side slide shaft and at least one right side bearing slidably supported on said right side slide shaft, said hinge being rigidly supported on said bearings.

5. The apparatus of claim 4 wherein said left side shaft slidably supports two rigidly interconnected left side bearings and said right side shaft slidably supports two rigidly interconnected right side bearings, said left side bearings and said right side bearings being rigidly interconnected by a cross brace.

6. The apparatus of claim 5 additionally comprising bias springs connected to said bed and to said cross brace.

7. The apparatus of claim 2 wherein said frame additionally comprises exercise equipment supporting members fixed to said base plates and extending therefrom into said bed space, said exercise equipment being fixed to said exercise equipment supporting members.

8. A combined bed and exercise apparatus comprising, in combination:

a frame adapted to be firmly fixed in place and comprised of a pair of base plates;

a bed;

a hinge fixed to said frame and supporting said bed such that said bed may be pivoted between a horizontal position concealing an exercise area therebeneath and a vertical position exposing said exercise area; and, collapsible exercise equipment positioned in said exercise area, usable when said bed is in said vertical position, and concealed when collapsed and said bed is in said horizontal position;

said base plates supporting hinge positioning means in turn supporting said hinge in a first position when said bed is in the horizontal position such that said bed is disposed near an adjacent wall, said hinge positioning means supporting said hinge in a second position when said bed is in the vertical position such that said bed upper surface is disposed near said adjacent wall, said hinge positioning means being comprised of a left side slide shaft fixed to one of said base plates, a right side slide shaft fixed to the other one of said base plates, at least one left side bearing slidably supported on said left side slide shaft and at least one right side bearing slidably supported on said right side slide shaft, said left side and right side bearings being rigidly interconnected by a cross brace, and said hinge being rigidly supported on said bearings.

9. The apparatus of claim 8, wherein said hinge positioning means includes yieldable stop means on each of said left and right side bearings and selectively engageable with respective ones of a pair of stop shoulders formed on each of said slide shafts to releaseably hold the said hinge selectively in one or the other of said first and second positions.

10. The apparatus of claim 3, wherein the said bed includes a rectangular configured bed frame having a foot rail, and a pair of foot end legs mounted on said foot rail and adapted to support the foot portion of said bed when said bed is in said horizontal position.

* * * * *